US005544770A

United States Patent [19]

Travisano

[11] Patent Number: 5,544,770

[45] Date of Patent: Aug. 13, 1996

[54] TAMPER EVIDENT SEAL AND SYSTEM

[76] Inventor: Frank P. Travisano, 601-B Waverly Way, Jamesburg, N.J. 08831

[21] Appl. No.: 57,809

[22] Filed: May 7, 1993

[51] Int. Cl.[6] ..... B65D 39/00

[52] U.S. Cl. ..... 215/230; 215/232; 215/246; 215/250; 215/253; 215/254; 215/347; 215/349; 206/807

[58] Field of Search ..... 215/246, 250, 215/251, 253, 254, 230, 232, 201, 206, 341, 347, 349; 206/459, 807

[56] References Cited

U.S. PATENT DOCUMENTS

| | | | |
|---|---|---|---|
| 2,447,983 | 8/1948 | Little . | |
| 2,790,286 | 4/1957 | Snyder . | |
| 3,095,103 | 6/1963 | Harrison . | |
| 3,955,699 | 5/1976 | Amberg et al. | 215/246 |
| 4,004,705 | 1/1977 | Fujio | 215/246 |
| 4,454,956 | 6/1984 | Patterson | 215/250 X |
| 4,511,052 | 4/1985 | Klein et al. . | |
| 4,538,740 | 9/1985 | Petersen, Jr. | 215/246 |
| 4,545,494 | 10/1985 | Sawicki | 215/232 |
| 4,652,473 | 3/1987 | Han . | |
| 4,890,763 | 1/1990 | Curiel | 220/455 |
| 4,998,666 | 3/1991 | Ewan | 229/102 |
| 5,082,702 | 1/1992 | Alband | 215/230 X |
| 5,197,618 | 3/1993 | Goth | 215/232 |

*Primary Examiner*—Allan N. Shoap
*Assistant Examiner*—Stephen Cronin

[57] ABSTRACT

A tamper evident seal and system for use on a variety of container and closure combinations providing a seal across the juncture of the container and closure or across the container opening and positive indication to consumers of tampering with the seal. The seal system comprises the combination of indicia specifically placed on the container and a seal means in the form of a heat shrink band or a foil sheet applied to the container in a manner so as to temporarily obscure the indicia. In a first embodiment the indicia is applied to the container in an area below the neck and the seal means comprises an opaque band adhered to the container and closure over the juncture of thereof and over the indicia. In a second embodiment, the indicia is applied to the lip around the container mouth and the seal means comprises a foil sheet adhered to the lip and covering the mouth. A third embodiment combines the two individual forms into a double seal system comprising the inner foil sheet and indicia and the outer opaque band and indicia.

13 Claims, 2 Drawing Sheets

TAMPER EVIDENT SEAL AND SYSTEM

BACKGROUND OF THE INVENTION

The present invention relates to a tamper evident seal and system for containers whereby a consumer may be assured that the seal on a product has not been tampered with prior to purchase. The invention is particularly directed to an improved combination of a tamper evident seal and indicia for use on bottles and similar product packaging.

Heat shrink seals are in common use on a variety of products in the market place as a means to reduce or prevent tampering with such products. The application of a seal occurs at the time of packaging the product after a closure has been applied to the product container and the seal generally remains intact until the ultimate purchaser removes it. In this manner the purchaser is generally assured that the product within the package is in the same condition as when it was initially packaged and has not been tampered with at any point between its manufacture and purchase.

Prior seal means have generally been limited to heat shrink collars placed over the cap and neck of a bottle and shrunk into place. Occasionally, a secondary seal or label, generally in the nature of a tax stamp, is first applied and the collar then shrunk thereover. These types of seal means are represented by U.S. Pat. No. 2,447,983 to Little, U.S. Pat. No. 2,790,286 to Snyder and U.S. Pat. No. 3,095,103 to Harrison. The Little patent discloses a heat shrinkable sleeve having an opaque portion and a transparent portion which is designed to be used in combination with a tax stamp placed over the package closure. The sleeve is oriented so that the tax stamp shows through the transparent portion. Snyder discloses a secondary closure in the nature of a shrink wrap sleeve which is dipped in a swelling agent to render the sleeve tacky so that it will adhere to the container when shrunk. As an alternative, Snyder also discloses that a heat activatable adhesive may be coated on the inner surface of the sleeve instead of using the swelling agent. Although the present invention may also employ a heat activatable adhesive, there are other aspects which are neither disclosed nor suggested by the Snyder patent and which will become clear in the subsequent discussion. The Harrison patent discloses a heat shrink closure or seal which is applied in combination with a tear strip, the shrinking of the seal material serving to hold the tear strip in place. However, the tear strip is not itself adhered to the container.

Such prior art seals have a significant drawback in that there is no provision for a means to directly inform the purchaser that there should have been a seal on the container wherein that information is in direct proximity to the seal and is not revealed until the seal is removed and which is itself not readily removable. Other methods of providing such information have generally been limited to fine print on product labels which are more often overlooked than looked at. In contrast, the present invention provides a combination of seal means and indicia which may be used on any closure/container combination and which provides a direct cooperative relationship between the seal means and indicia which are directly applied to a container and/or closure to thereby alert the consumer that the seal has been removed or compromised. An alternative embodiment provides a combination of seal and indicia which is even more readily evident of an attempted seal removal when the seal has not been completely removed and which is positioned on a container in a manner such that it is not visible until a container closure has been removed.

Still other seals and methods employ complex color change compositions or two part tape means whereby removal, or attempted removal results in the exposure of a color change composition or indicia which is part of the seal means such that warning of the prior opening is given to the purchaser by a color change or the exposure of indicia which is an integral part of the tape and which is ultimately removable from the container. These types of seals are represented in the prior art by U.S. Pat. No. 4,511,052 to Klein, et al., which discloses a color change means, and U.S. Pat. No. 4,652,473 to Han, which discloses a two part tape having an exposable color or indicia bearing portion adjacent an adhesive and which is thin and deformable when removal is attempted. However, in Han the indicia is part of the sealing tape and there is nothing to restrict its complete removal with the effect that the consumer has no direct warning that a seal should have been present but has been removed. Similarly, the color change tape of Klein, et al., may also be completely removed leaving no indication to the consumer that a safety seal was present but has been removed.

SUMMARY OF THE INVENTION

It is an object of this invention to provide a tamper evident seal system which is simple to use and which provides direct evidence to the consumer of its prior removal.

It is a further object of this invention to provide a tamper evident seal system which includes indicia in direct cooperation with a seal means on a container.

It is an even further object of this invention to provide a tamper evident seal system which includes indicia specifically positioned on a package so as to be obscured from view until removal of the seal means.

Further objects will become evident from the following discussion and drawings.

The present invention provides a tamper evident seal system which comprises, in combination, a container having a removable closure and a tamper indicating seal means applicable over the container and closure, wherein the seal means comprises a sleeve or band of heat shrinkable material of a size to extend over the closure and at least the adjacent portion of the container to include an area below the neck and the tamper indicating means comprises indicia permanently applied to the container.

In addition, the present invention presents a tamper evident seal system for a container having a removable closure wherein the seal means comprises a band of opaque heat shrinkable material for application over the container and closure, and wherein indicia warning of the absence of the seal means is permanently applied to the container so as to be obscured when the band is in place. The present invention further provides an alternative form of the system wherein the seal means comprises a film or foil material adhered across the mouth of the container with the indicia applied to the lip of the container wall surrounding the mouth. In this manner, the indicia is exposed when the seal is peeled from the mouth of the container. A closure is normally placed over the container mouth and the seal means. These two forms of the present invention, although designed for individual use, may be combined to provide a double seal; i.e., the outer heat shrink band and the inner peel seal. In addition, the system of this invention may be used in conjunction with the seal means of applicant's copending application Ser. No. 07/909,762, the disclosure of which is incorporated herein by reference.

DETAILED DESCRIPTION OF THE INVENTION

Figure 1:
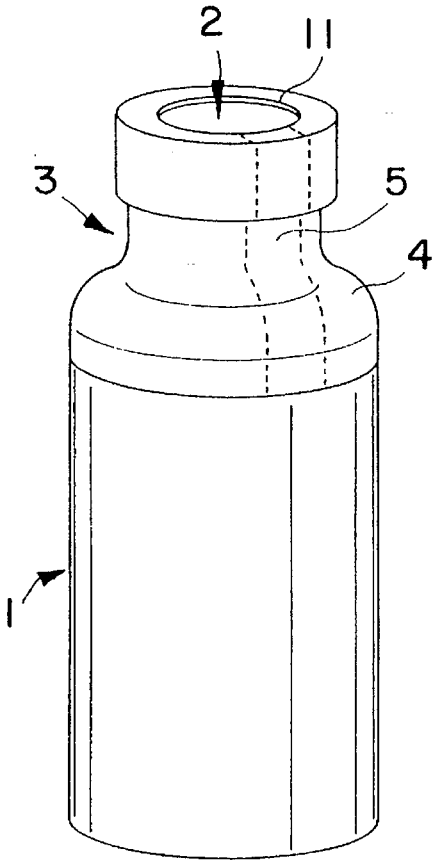
FIG. 1 is an oblique view of a bottle and cap with a safety seal of the present invention thereon.
Figure 2:
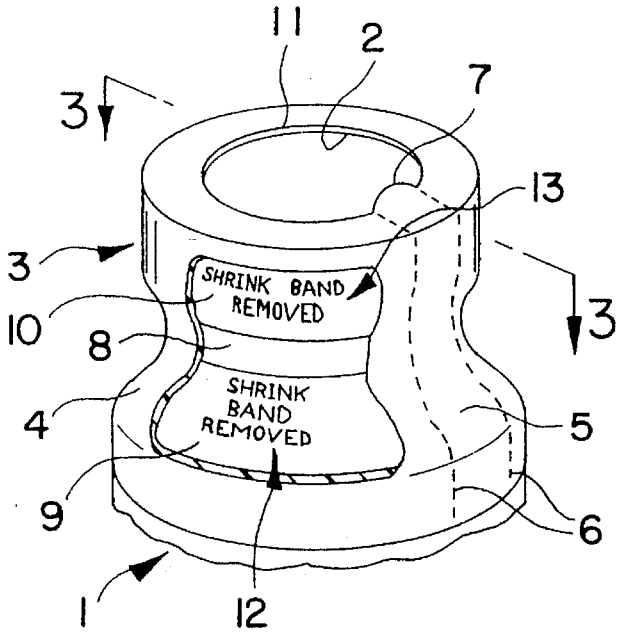
FIG. 2 is an enlarged view of the cap and shoulder area of the bottle of FIG. 1 with a portion of the outer seal band removed to show the bottle and cap indicia.

The present invention provides an improved, cost effective, tamper evident seal system which is easily achieved with heat shrink or adhesive bands or seals yet provides a ready means of warning the consumer that such seal means have been removed. The invention will be described in combination with a bottle and threaded cap, although it would be suitable for use on other types of packages or containers including bottles with snap on caps, bayonet closures, two part containers, bottles without a defined neck area, and the like. FIG. 1 illustrates the basic arrangement of the system in place on a bottle; the system comprising a container, in this case a bottle 1, cap 2 and seal 3 with indicia on the bottle 1 obscured by the seal 3. As more clearly shown in FIGS. 2 and 3, the seal 3 preferably comprises a band or sleeve 4 of heat shrink material which provides a primary seal over the cap 2 and bottle 1, forming an outer safety band. The band may include a tear strip 5 which is preferably defined by spaced parallel lines of weakening or perforations 6. This tear strip 5 may include a tab 7 at one end which is graspable by the consumer to assist in removal of the strip 5 thereby releasing the band 4. Although it is preferred that a double line of perforations or the like define the tear strip 5, a single line of weakness may suffice to separate the band 4 for removal.

Returning to FIGS. 1, 2 and 3, band 4 is preferably of a length to extend from an area inward of the edge of cap 2 downward over the neck 8 and shoulder 9 of bottle 1. Prior heat shrink seals have generally only covered the skirt 10 of cap 2 and the neck 8 of bottle 1. Band 4 preferably has an upper edge 11 and does not completely cover the upper surface of cap 2 thereby permitting the seal means 3 to be used in conjunction with button caps wherein a pop-up button is provided as an indication that a pressure seal on the package has been broken.

The system of the present invention is a combination of a seal means and indicia specifically placed on a container so as to instruct the consumer as to the proper relationship of the parts of the system. Indicia 12, therefor, is printed or otherwise applied to the shoulder 9 of the container 1 and comprises wording such as "OUTER SAFETY BAND REMOVED" or "SHRINK BAND REMOVED" or other appropriate wording to alert the consumer that band 4 was present and has been removed. While it is within the scope of this invention to provide indicia on both bottle 1 and cap 2, at the very least indicia 12 on bottle 1 must be present within the system since it is far more difficult to switch a complete package than it would be to merely substitute a different cap. Placing the indicia on the bottle rather than on a second layer of a shrink band or tape also prevents the complete removal of all indicia related to a safety seal. Indicia 12 is preferably applied to the shoulder area 9 of bottle 1 while indicia 13 on cap 2 may be applied to skirt 10 or to the top surface of cap 2. Wherever indicia 12 and 13 are placed they must be in a position so as to be covered by band 4 when it is applied and to be clearly evident to the consumer when band 4 is removed. In addition, while the indicia 12 and 13 may be in any color, it is preferred that the warning be presented in a color which is bright and in contrast to the color of the container. It is particularly important to this invention that the indicia 12 on the container be readily apparent to the consumer upon removal of the band 4.

The manufacture of seal means 3 is preferably by extrusion of the heat shrink material through a die to form cylindrical band 4. Such a die may be provided with means to produce the tear strip 5 as the band is extruded. The material from which band 4 is produced may be any commonly used heat shrink material but is preferably an opaque polyvinylchloride film. One such film is GENOTHERM GZ 44, marketed by American Hoechst. Such materials may be extruded and oriented into any shape or arrangement needed.

As an alternative to extrusion, the band 4 material may be formed in a sheet and rolled into the cylinder form of band 4 with the overlapping edges secured by any suitable means. The tear strip 5 may be formed before or after the sheet is rolled, but preferably before. Any indicia which may be desired on the band 4 may be printed on the heat shrink material before or after it is rolled into a cylinder. Any method of printing may be used including such methods as offset, intaglio, ink jet or the like. Where band 4 is formed by extrusion, any appropriate printing method may also be used to apply indicia thereto either in conjunction with extrusion or after it.

With regard to indicia 12 and 13 applied to bottle 1 and cap 2, these may be printed onto bottle 1 and cap 2 by standard means or they may be applied through the medium of band 4. To achieve this alternative application of indicia 12 and 13, the wording therefor is applied to the inner surface of band 4 in reverse using an ink which will transfer to bottle 1 and cap 2 upon the application of heat and/or pressure when band 4 is shrunk to fit. In addition, the ink may have the property of changing color when exposed to light or air after activation by heat or pressure. Whatever means is used to apply indicia 12 and 13, it must be such that the indicia are permanent and indelible and therefor cannot be removed. Where the material from which the container is made permits, the indicia 12 may be applied with a dye which will stain the material of the container. As noted previously, indicia 12 and 13 are preferably wording such as to alert the consumer to the absence of the seal 3; however, with sufficient education, the indicia 12 and 13 could also be symbols or colors which would be readily recognizable as meaning the absence of a seal means.

Figure 3:
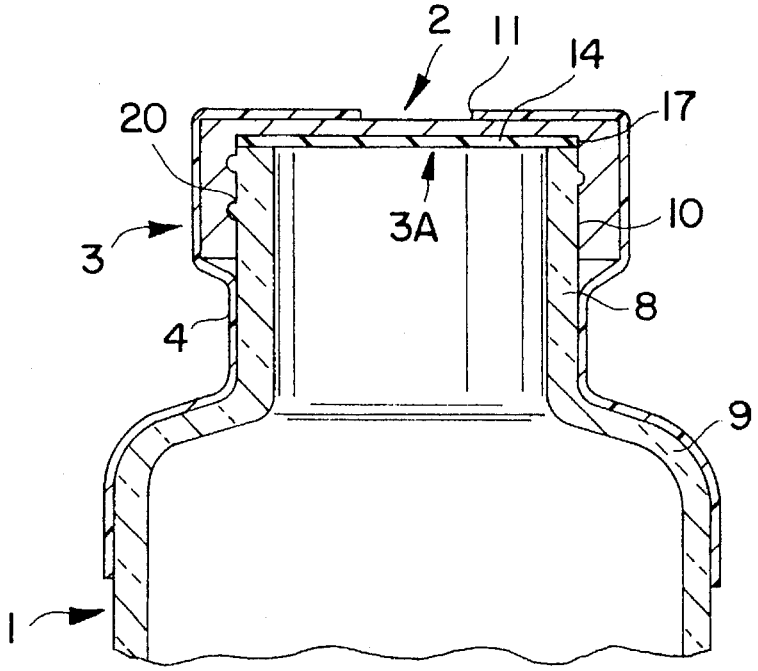
FIG. 3 is a vertical cross section of FIG. 2 taken along line 3—3 and showing a configuration of the invention combining both the heat shrink band and the peel seal forms of the invention.

Application of the seal means 3 to a package such as the bottle 1 and cap 2 combination shown is achieved by first forming the band 4 either by extrusion or by rolling a flat sheet of material into a cylinder. The thus formed band 4 is then applied over the bottle 1 and cap 2 combination on which at least indicia 12 has been printed as described and exposed to heat thereby causing band 4 to shrink into tight engagement with bottle 1 and cap 2. The shrinkage of band 4 should be of a degree such that the material will conform closely to the outer configuration of the bottle 1 and cap 2 as shown in FIG. 3 and will cover and obscure indicia 12 on the shoulder 9 of bottle 1. As an added feature, and to make inadvertent removal of the seal means 3 more difficult, an adhesive may be applied to the inner surface of band 4. Any adhesive may be used but preferably it will be a heat activated adhesive such that the heat used to shrink band 4 will also activate the adhesive while the pressure caused by the shrinkage of band 4 will provide a clamping force to ensure a good adhesion to the bottle 1 and cap 2. Where a pressure sensitive adhesive is used, the clamping pressure of the shrinking band will cause adhesion. In the case of radiation activated adhesives, the band may be subjected to appropriate wavelengths of radiation before or after shrinkage. Heat activated adhesives are preferred and may be co-extruded with the band material or otherwise printed or laminated to the band 4. Preferably, such an adhesive should activate at the temperature at which the band material shrinks. Examples of such adhesives are KAN TAK No. 34-4987 and INSTANT-LOK No. 34-4977 produced by National Starch and Chemical Co. Whatever kind of adhesive is used it should also be such as to not readhere once its contact with the bottle 1 has been broken. In this manner it is not possible to then partially remove a seal 3, tamper with the contents of the container 1, then reapply the same seal 3. In addition, any attempted but aborted removal of the seal 3 will be readily evident by the looseness caused by failure of the adhesive to readhere.

Figure 4:
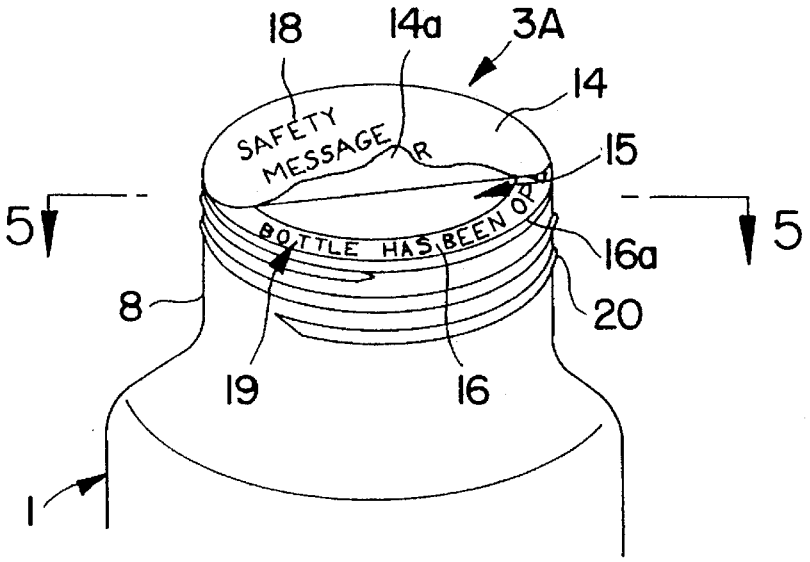
FIG. 4 is an oblique view of the cap and shoulder area of a bottle with the alternative peel seal form of the present invention partially removed.
Figure 5:
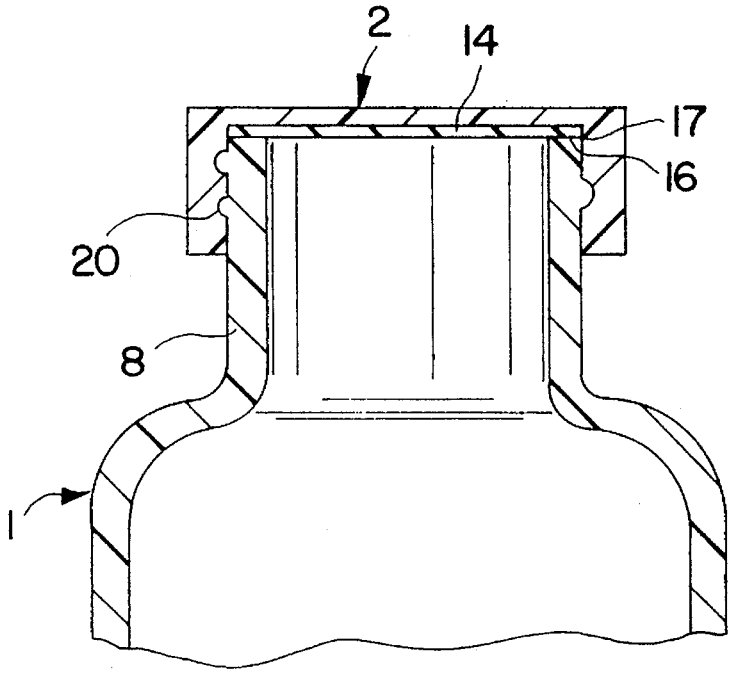
FIG. 5 is a vertical cross section taken along line 5—5 of FIG. 4 showing the peel seal embodiment with a cap in place.

In the alternative embodiment of FIGS. 4 and 5, the seal means 3A comprises a film or foil 14 which is adhered across the mouth 15 of bottle 1 which has warning indicia 19 printed on the lip thereof. A tab **14*a* by which film 14 may be grasped and peeled from the bottle 1 is preferably included. Film 14 is adhered to the lip 16 surrounding mouth 15 preferably by a suitable adhesive 17 as hereinbefore described. As with the first embodiment of this invention, the adhesive 17 may be any type which provides good adhesion between the material of the film 14 and the bottle 1 while permitting removal of the film 14 when it is desired. Such adhesives include but are not limited to heat activated adhesives, pressure sensitive adhesives and radiation activated adhesives. Also, as in the first embodiment, the adhesive used should be such as to not readhere to the container once the seal therebetween has been broken. The adhesive 17 may coat the entire underside of the film 14 but is preferably only applied as a ring around the perimeter of the film 14 corresponding to the area of the lip 16. Alternatively, the adhesive 17 may be applied to the lip 16 and the film 14 laid thereover or the material of film 14 may be such as to become adhesive under the conditions of application to the bottle 1**.

Suitable materials for the film 14 include plastic films, metal foils, metallized plastic or plasticized metal films and foils, paper and any combinations thereof. As a further alternative, film 14 may be made from a heat shrink material, such as that used for band 4, and is applied to bottle 1 so that upon shrinkage it will gather about the outer edge **16*a* of lip 16 and seal thereto. As with band 4**, this form may be applied in combination with an adhesive for added security and the adhesive should be one which will not readhere once the seal has been broken.

In this embodiment, warning indicia 18 may be provided on the outer surface of the film 14 to alert the consumer that a message is located under the seal provided by the film 14. A second warning indicia 19, corresponding to indicia 12 of the first embodiment, is printed or otherwise applied on the lip 16 so as to be covered when film 14 is in place. As with the previous embodiment, any suitable means for applying the indicia 19 which will result in a permanent mark may be employed including transfer from the film 14 upon its application to the bottle 1.

The seal means 3A of this embodiment may be applied to any type of container having a separate cap which is fully removable. Although the figures illustrate a cap 2 and bottle 1 combination employing cooperating threads 20, the present embodiment is applicable to snap on caps, bayonet closures or any other type of closure wherein the cap 2 fits over the mouth 15 and is separable from the container 1.

The embodiments of this invention may be used separately or in combination with each other on the same container. This combined use is illustrated in FIG. 3 which combines the outer seal means 3 of FIGS. 1 and 2 with the inner seal means 3A of FIGS. 4 and 5 to provide a double tamper evident safety seal. In this combined use the indicia 12 and 19 will be such as to indicate removal of the outer seal 3 and removal of the inner seal 3A respectively.

The foregoing describes the preferred embodiments of the present invention. Any modifications or changes which may become apparent to those skilled in the art from this disclosure are deemed to be included within the scope of the following claims.

What is claimed is:

1. A tamper evident seal system comprising, in combination, a container having an open mouth, a closure adapted for removable engagement with said container over said mouth, and first and second independent tamper evident seal means applied to said container wherein said first tamper evident seal means comprises first warning indicia printed on said container at a location below said closure and a band of opaque heat shrink material applied about said closure and said container and having a length to extend beyond the location of said first warning indicia whereby said first warning indicia is temporarily covered and obscured by said band when said band is applied, and wherein said second tamper evident seal means comprises second warning indicia printed on a circumferential lip of said container mouth and an opaque foil sheet peelably adhered to said container over said mouth and said second warning indicia, whereby said second warning indicia is temporarily covered and obscured by said sheet when said sheet is applied, whereby said first and second warning indicia, when exposed by removal of said opaque band and sheet, signify that said seal system has been tampered with.

2. The tamper evident seal system of claim 1 wherein said band of heat shrink material comprises a hollow cylinder adapted to fit over said closure and container and to be shrunk in place thereon and having a portion defined by at least one line of weakness whereby said seal may be ruptured for removal from said container and closure.

3. The tamper evident seal system of claim 2 wherein said container includes a definable shoulder portion below said closure, said first warning indicia is printed on said shoulder portion and said seal means extends below said shoulder portion.

4. The tamper evident seal system of claim 1 wherein said opaque band and foil sheet are applied to said container with an adhesive which resists readherence following removal of said opaque band and foil sheet from said container.

5. The tamper evident seal system of claim 1 further comprising an adhesive applied to said band whereby said adhesive adheres to said container and to said closure upon shrinkage of said band.

6. The tamper evident seal system of claim 1 wherein said foil sheet is adhered to said lip by means of an adhesive applied to said sheet.

7. The tamper evident seal system of claim 1 wherein said foil sheet is adhered to said lip by means of an adhesive applied to said lip.

8. The tamper evident seal system of claim 1 wherein said foil sheet is a heat shrink material and is applied to said container in a manner whereby said sheet is shrunk around said lip.

9. A tamper evident seal system comprising, in combination, a container having a neck portion comprising a lip surrounding an open container mouth, a closure adapted for removable engagement with said neck over said mouth and two independent tamper evident seal means, wherein a first tamper evident seal means is located between said mouth and said closure and comprises a first warning indicia printed on said lip of said container and a removable opaque foil sheet adheringly applied over said mouth and said lip of said container whereby said first warning indicia is temporarily covered and obscured, and a second tamper evident seal means is located over said closure and said container and comprises a second warning indicia printed on said container below said neck and a removable opaque band placed over and closely engaging said container and closure whereby said band extends over said container and closure whereby said second warning indicia is temporarily covered and obscured.

10. The tamper evident seal system of claim 9 further comprising an adhesive applied to said foil sheet and to said opaque band whereby said adhesive secures said foil sheet and said opaque band to said container and resists readherence of said foil sheet and said opaque band to said container following removal of said foil sheet and said opaque band.

11. The tamper evident seal system of claim 10 wherein said first and second warning indicia comprise messages to consumers printed on the surface of said container in a manner to be permanent and non-removable upon removal of said sheet and said band, whereby said messages alert said consumers to the absence of said sheet and said band.

12. The tamper evident seal system of claim 10 wherein said adhesive is applied to said opaque band of said second tamper evident means in a manner such that said adhesive adheres to said container and to said closure when said band is placed over said container and closure.

13. The tamper evident seal system of claim 9 wherein said foil sheet and said opaque band are made from heat shrink material.

* * * * *